US009108708B1

(12) United States Patent
Venalainen

(10) Patent No.: US 9,108,708 B1
(45) Date of Patent: Aug. 18, 2015

(54) SMALL VESSEL MARINA

(71) Applicant: Olavi Venalainen, Kuopio (FI)

(72) Inventor: Olavi Venalainen, Kuopio (FI)

( * ) Notice: Subject to any disclaimer, the term of this patent is extended or adjusted under 35 U.S.C. 154(b) by 0 days.

(21) Appl. No.: 14/244,340

(22) Filed: Apr. 3, 2014

(51) Int. Cl.
*B63C 3/08* (2006.01)
*B63C 3/12* (2006.01)
*B63C 3/02* (2006.01)

(52) U.S. Cl.
CPC ... *B63C 3/08* (2013.01); *B63C 3/02* (2013.01); *B63C 3/12* (2013.01)

(58) Field of Classification Search
CPC ..... B63C 3/00; B63C 3/08; B63C 3/12; B63C 13/00
USPC ..... 114/44, 344; 405/1, 2
See application file for complete search history.

(56) References Cited

U.S. PATENT DOCUMENTS 6,182,597 B1 2/2001 Maxwell et al. ..... 114/344
2010/0067985 A1 3/2010 Imel et al. ..... 405/3

FOREIGN PATENT DOCUMENTS

FI 20125436 10/2013
JP 8-120659 5/1996

*Primary Examiner* — Lars A Olson
(74) *Attorney, Agent, or Firm* — Harrington & Smith

(57) ABSTRACT

The invention relates to a small vessel marina which includes a stocks framework, which contains sliding elements at a distance from each other and joining beams between them, a boat trailer for a boat, which boat trailer is installed on top of the sliding elements and arranged movable along them, and in front of the boat trailer is connected a pier with steps with a connecting rail, which pier is movable along the boat trailer on top of the sliding elements.

4 Claims, 1 Drawing Sheet

Figures 1, 2, 3:
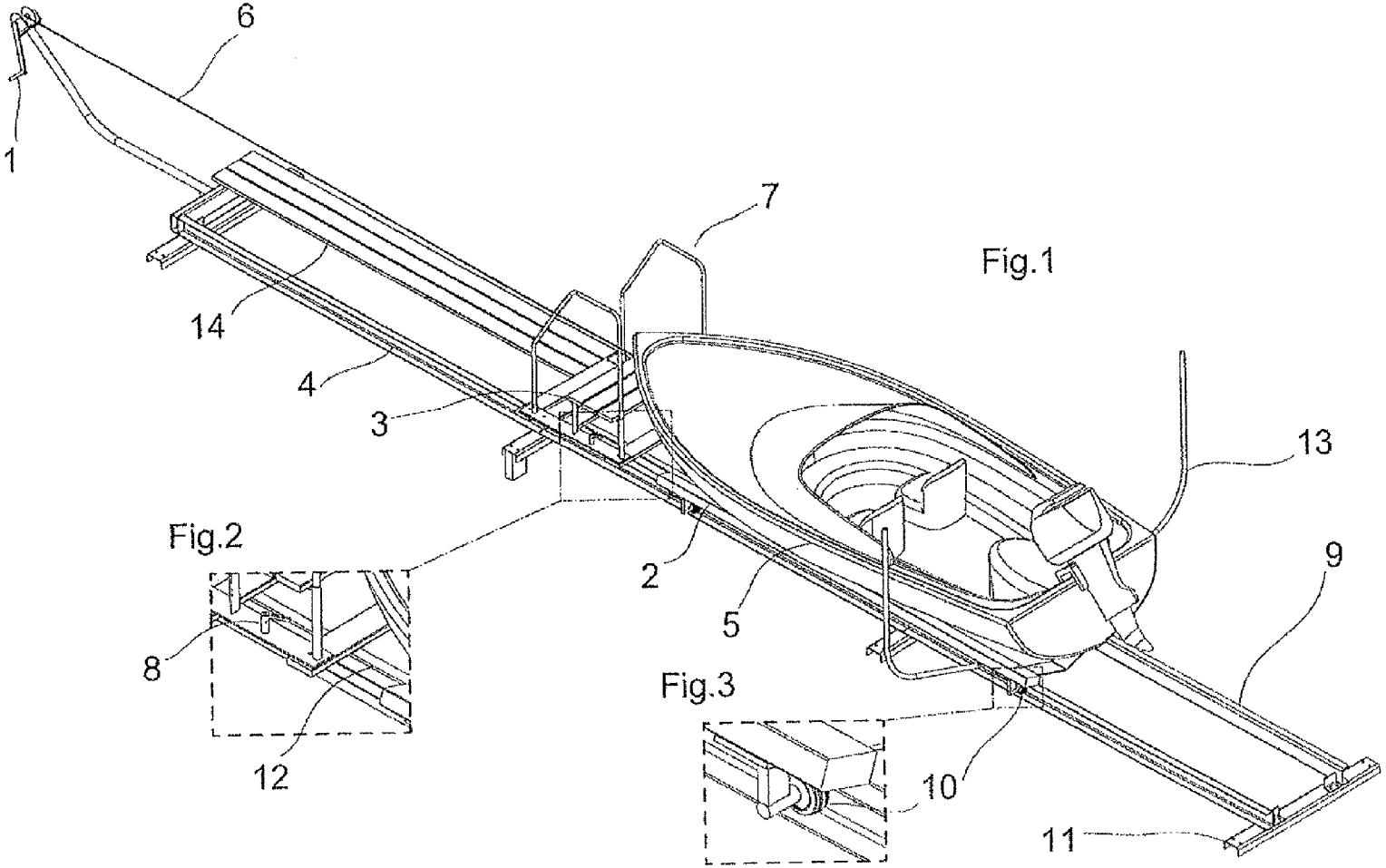

1
2
3
4
5
6
7
8
9
10
11
12
13
14

SMALL VESSEL MARINA

The invention relates to a small vessel marina which includes a stocks framework which contains sliding elements being at a distance from each other and joining beams between them as well as a boat trailer for a boat which boat trailer is installed on top of the sliding elements and is arranged movable along them.

Small vessels are stored on shores on top of various boat racks. A conventional boat rack includes a support structure and at its lower end a stocks structure which contains rotating stocks extending on both sides. The stocks facilitate pulling the boat on top of the boat rack.

On shallow shores, the height of water varies considerably. Water is at its highest in the early summer and at its lowest in the autumn. Recently, boat racks have to be transferred as the height of water changes in order to be able to get the boat in the water easily. If the boat has not been used for a long time, getting it in the water can be very difficult. Recent boat racks are small-sized and they are to be positioned such that the boat rack is partially in water in order to be able to get the boat in the water easily. Then, a problem is that, when the boat is launched, no one is able to enter the boat with their feet dry from the shore or entering the boat without getting their feet wet is awkward, because the boat is at the end of the boat rack usually at some distance from the shore. There will be more problems if the shore is muddy or slimy. If there is no pier nearby, the boat must be entered by walking on top of the boat rack, which is awkward. Similarly, exiting the boat without getting their feet wet is difficult when using recent boat racks. Furthermore, a common problem is getting the boat in the exactly right spot i.e. at the point of the boat rack when returning to the shore.

The object of the invention is to introduce a small vessel marina by means of which the launching of the boat and entering the boat, the coming ashore, exiting the boat and pulling the boat to the shore are facilitated. Furthermore, the object of the invention is to introduce a small vessel marina which is simple and functional of its structure and which is cost-effective to manufacture.

The object of the invention is achieved with a small vessel marina which is characterised by what is presented in the claims.

The small vessel marina according to the invention includes a pier with steps connected to the front of the boat trailer, which pier is movable along the boat trailer on top of the sliding elements. In the small vessel marina, the boat trailer, on top of which the boat is, and the pier in the front of the boat trailer are always together, whereby it is possible to enter and exit the boat easily via the pier. The small vessel marina according to the invention facilitates the launching of the boat and entering the boat, the coming ashore, exiting the boat and pulling the boat to the shore. All these stages can be done without stepping into water and without wearing rubber boots or equivalents.

In an advantageous embodiment of the invention, the small vessel marina includes several sliding elements fastened to each other one after the other, which are on both sides of the construction. Hence, the length of the small vessel marina can be selected in accordance with the shore by positioning a desired number of sliding elements one after the other. Usually, the small vessel marina is constructed so long that it functions well and the boat can be launched and got ashore without moving the small vessel marina, even though the height of water varies during the year. The small vessel marina can also be used as a winter marina and the boat can be stored for winter on top of it when the shore-side end of the small vessel marina is at a suitable height on the shore.

The invention will now be described in more detail with reference to the accompanying drawing in which FIG. 1 shows an oblique side view of a small vessel marina according to the invention, FIG. 2 shows a detail of FIG. 1 at a larger scale and FIG. 3 shows another detail of FIG. 1 at a larger scale.

The small vessel marina according to FIGS. 1-3 includes a stocks framework 9 which contains sliding elements 4 at a distance from each other and joining beams 11 between them. Furthermore, the small vessel marina includes a boat trailer 2 provided with wheels 10 or equivalents, which trailer is installed on top of the sliding elements 4 and is movable along them. With a connecting rail 12 according to FIG. 2, to the boat trailer is connected a pier with steps 3 which is movable along the boat trailer on top of the sliding elements. Below the pier, there are wheels supported by which it is movable. Additionally, the small vessel marina includes a pulling device fastened on the shore-side end of the sliding elements by means of a support frame, such as a winch 1. The wire cable or line 6 of the winch 1 is fastenable to the front ring of the boat.

The small vessel marina includes several sliding elements 4 fastened to each other one after the other, of which there are an equal number on both sides of the construction. The sliding elements have been manufactured of corrosion-resistant material. On the long side of the sliding elements, there is a recess or a groove for the wheels of the boat trailer and the pier. At the fastening point of the sliding elements, there is a transversal joining beam 11. Furthermore, the ends of the construction include transversal joining beams 11. The length of the small vessel marina can be increased by adding sliding elements one after the other on both sides.

The shape of the boat trailer 2 is an extremely low gradient letter V and its shape and construction are such that a boat 5 can be easily brought on top of it by swimming the boat. At the outmost end of the boat trailer, there are side supports 13 fastened to it which supports are bars or equivalents extending, first, obliquely outwards and, after that, upwards.

The pier with steps 3 according to the figure includes rails 7 and, on the side of the boat, a step to facilitate entering the boat. The rails can be adjustable in the height direction. The pier with steps includes a locking element or locking elements 8 in its bottom part for locking it in place in the sliding elements. Additionally, the pier with steps includes a detachable platform 14 which is positionable on top of the sliding elements on the other side.

The small vessel marina is used for storing a boat on a shore. When the boat is not used, it can be fastened in place by means of the cable wire of the winch. It is also possible that, in long-term storing, the boat is fastened in its place by a locking element or elements in the boat trailer and/or the pier, whereby the fastening can be secured. Usually, the boat is then at least partially out of the water.

When launching the boat, one lowers the boat trailer 2 and the boat 5 together with the pier 3 by the winch 1 along the sliding elements 4 so far that the outer end of the boat trailer is under water. When the boat 5 has reached water and lifted a little upwards from the boat trailer 2 due to the effect of water, one walks along the pathway 4 without getting one's feet wet to the pier 3 and detaches the wire cable/line 6 from the front ring of the boat and fastens it to the rail 7. Then, one locks the pier in place to the sliding element by the locking element 8 and enters the boat via the steps of the pier 3. The boat is released by pushing the boat 5 from the rail 7 onto water or getting it away from the small vessel marina by running the engine.

When entering ashore, one approaches the shore and the small vessel marina at a suitable speed and drives the boat 5 guided by the side supports 13 of the boat trailer on top of the boat trailer 2 such that the prow and the front part of the boat 5 come between the rails 7. One disembarks the boat to the pier, detaches the wire cable/line 6 of the winch and fastens it to the front ring of the boat. The passengers can then transfer via the pier and the pathway ashore without getting their feet wet. Then, one opens the locking element 8 of the pier and winches the boat trailer 2, the boat 5 and the pier 3 together upwards at a desired height by the winch 1.

The invention is not limited to the advantageous embodiment described, but it can vary within the scope of the inventive idea presented in the claims.

The invention claimed is:

1. A small vessel marina which includes a stocks framework, the stocks framework contains sliding elements at a distance from each other and joining beams between them, a boat trailer for a boat, which boat trailer is installed on top of the sliding elements and arranged movable along them, and in front of the boat trailer is connected a pier with steps with a connecting rail, which pier is movable along the boat trailer on top of the sliding elements.

2. A small vessel marina according to claim 1, which includes several sliding elements fastened to each other one after the other, which are on both sides of a construction.

3. A small vessel marina according to claim 1, which includes a pulling device fastened on a shore-side end of the sliding elements by means of a support frame.

4. A small vessel marina according to claim 3, the pulling device is a winch.

* * * * *